US011053098B2

(12) United States Patent
Christen et al.

(10) Patent No.: US 11,053,098 B2
(45) Date of Patent: Jul. 6, 2021

(54) ELEVATOR SYSTEM AND METHOD FOR CONSTRUCTING SUCH AN ELEVATOR SYSTEM

(71) Applicant: Inventio AG, Hergiswil (CH)

(72) Inventors: Lukas Christen, Kilchberg ZH (CH); Stefan Weber, Niederwil AG (CH)

(73) Assignee: INVENTIO AG, Hergiswil (CH)

( * ) Notice: Subject to any disclaimer, the term of this patent is extended or adjusted under 35 U.S.C. 154(b) by 169 days.

(21) Appl. No.: 16/346,564

(22) PCT Filed: Nov. 21, 2017

(86) PCT No.: PCT/EP2017/079868
§ 371 (c)(1),
(2) Date: May 1, 2019

(87) PCT Pub. No.: WO2018/099761
PCT Pub. Date: Jun. 7, 2018

(65) Prior Publication Data

US 2019/0276277 A1 Sep. 12, 2019

(30) Foreign Application Priority Data

Nov. 30, 2016 (EP) ..... 16201543

(51) Int. Cl.
*B66B 9/187* (2006.01)
*B66B 9/00* (2006.01)
(Continued)

(52) U.S. Cl.
CPC ..... *B66B 9/187* (2013.01); *B66B 9/003* (2013.01); *B66B 11/0005* (2013.01); *B66B 19/00* (2013.01)

(58) Field of Classification Search
CPC ..... B66B 9/187; B66B 9/003; B66B 11/0005; B66B 19/00
See application file for complete search history.

(56) References Cited

U.S. PATENT DOCUMENTS 5,033,586 A * 7/1991 Richards ..... B66B 9/187 187/259
5,513,724 A * 5/1996 De Jong ..... B66B 5/284 187/264

(Continued)

FOREIGN PATENT DOCUMENTS

CN 201250038 Y 6/2009
CN 102414108 A 4/2012

(Continued)

*Primary Examiner* — Michael A Riegelman
(74) *Attorney, Agent, or Firm* — William J. Clemens; Shumaker, Loop & Kendrick, LLP

(57) ABSTRACT

An elevator system arranged in an elevator shaft of a building in the construction phase grows with the building using a lifting process. The system includes a machine platform with an elevator drive machine and an elevator car suspended on the machine platform by a carrier. The elevator car is raised during the lifting process by a lifting device. The elevator system also includes an assembly platform that can be mechanically moved in relation to the machine platform along the elevator shaft. The lifting device includes a drive arranged on the machine platform and is also used to move the assembly platform.

13 Claims, 2 Drawing Sheets

(51) Int. Cl.
*B66B 11/00* (2006.01)
*B66B 19/00* (2006.01)

(56) References Cited

U.S. PATENT DOCUMENTS 8,944,219 B2 2/2015 Gerstenkorn
9,862,573 B2 1/2018 Puntener et al.
10,501,289 B2 * 12/2019 Rasanen ..... B66B 19/005
2011/0113720 A1 * 5/2011 Peacock ..... B66B 19/00 52/741.1
2012/0291395 A1 * 11/2012 Plathin ..... B66B 19/02 52/741.1
2013/0111723 A1 * 5/2013 Forsstrom ..... B66B 19/02 29/401.1
2013/0233655 A1 * 9/2013 Peacock ..... B66B 20/00 187/414
2013/0284543 A1 * 10/2013 De Jong ..... B66B 19/002 187/249
2014/0000987 A1 * 1/2014 Peacock ..... B66B 19/007 187/414
2014/0231179 A1 * 8/2014 Alasentie ..... B66B 7/062 187/251
2015/0034425 A1 * 2/2015 Ratia ..... B66B 11/008 187/249
2015/0307322 A1 * 10/2015 Peacock ..... B66B 7/064 187/254
2015/0362450 A1 * 12/2015 Lehtinen ..... G01N 27/20 187/391
2016/0152442 A1 * 6/2016 Weber ..... B66B 5/18 187/359
2018/0186607 A1 * 7/2018 Ratia ..... B66B 19/00
2018/0273349 A1 * 9/2018 Weibel ..... B66B 19/00
2018/0290863 A1 * 10/2018 Peacock ..... B66B 11/0045
2019/0023536 A1 * 1/2019 Christen ..... B66B 11/008
2019/0193995 A1 * 6/2019 Christen ..... B66B 11/0005
2019/0276277 A1 * 9/2019 Christen ..... B66B 11/0005
2019/0322491 A1 * 10/2019 Christen ..... B66B 19/00
2019/0330022 A1 * 10/2019 Christen ..... B66B 9/00
2020/0062549 A1 * 2/2020 Kim ..... B66B 11/0045
2020/0277158 A1 * 9/2020 Christen ..... B66B 19/002

FOREIGN PATENT DOCUMENTS

CN 102762484 A 10/2012
CN 105246816 A 1/2016
CN 105377738 A 3/2016
CN 205061252 U 3/2016
WO 2011080387 A1 7/2011
WO 2011148033 A1 12/2011
WO 2012072860 A1 6/2012

* cited by examiner

ELEVATOR SYSTEM AND METHOD FOR CONSTRUCTING SUCH AN ELEVATOR SYSTEM

FIELD

The invention relates to an elevator system which is installed in a building in the construction phase and grows with the increasing height of the building by using at least one lifting process, and to a method for erecting an elevator system in an elevator shaft of a building, in which a usable lifting height of the elevator system is adapted to an increasing height of the building.

BACKGROUND

US 2016/0152442 A1 discloses an elevator system in which, in a building in the construction phase, an elevator that is only partially erected so as to correspond to the current building height is used even prior to its completion. The elevator has a machine platform which can be moved along the elevator shaft and on which an elevator car is suspended by means of bearing means arranged in the elevator shaft. This machine platform is raised in each case in order to increase the usable lifting height of the elevator car in the elevator shaft. In order to raise the machine platform, a bearing structure that can be moved along the elevator shaft is provided which can be supported against the wall of the elevator shaft. In each case before the machine platform is raised, this bearing structure arranged above the machine platform is raised to a height by means of a first hoist that is attached in the upper region of the elevator shaft, during which the platform carried by this bearing structure can be raised by a particular distance. A second hoist arranged on said bearing structure is used to raise the machine platform.

The elevator system also comprises an assembly platform which can be arranged between the machine platform and the bearing structure. The assembly platform is used as a work platform from which elevator components, in particular guide rails for the elevator car and the counterweight thereof, can be mounted along the elevator shaft. However, US 2016/0152442 does not disclose whether, and if applicable how, the assembly platform can be lifted and lowered along the elevator shaft as required after the bearing structure has been raised to a new level and secured there.

The elevator system known from US 2016/0152442 A1 is disadvantageous in that at least two lifting devices are used in order to raise the machine platform and move the assembly platform, with at least the heavy drive of the lifting device having to be raised together with the bearing structure in order to raise the machine platform. Moreover, the movable bearing structure has to be provided with a power supply for said heavy drive.

SUMMARY

The problem addressed by the invention is that of providing an elevator system which is arranged in an elevator shaft of a building and grows with the increasing building height while the building is being erected by using at least one lifting process, and a method for erecting an elevator system in an elevator shaft of a building, in which method a usable lifting height of the elevator system is adapted to an increasing height of the building, and providing an elevator system which is produced by means of a method of this kind, with both the elevator systems and the method being designed so as to be simplified and more cost-effective.

Solutions and proposals for a corresponding growing elevator system, a corresponding method and an elevator system produced by means of a method of this kind are hereinafter presented that solve at least parts of the objects. In addition, advantageous, additional or alternative developments and embodiments are specified.

One solution to the problem consists of an elevator system which is arranged in an elevator shaft of a building in the construction phase and grows with the increasing height of the building by using at least one lifting process, a machine platform that comprises an elevator drive machine being provided and an elevator car that is suspended on the machine platform by means of at least one bearing means being provided, which machine platform and elevator car can be raised in the lifting process, the elevator system comprising a lifting device for raising the machine platform and the elevator car suspended on the machine platform, the elevator system comprising an assembly platform which can be mechanically moved relative to the machine platform along a portion of the elevator shaft, and said lifting device comprising a drive arranged on the machine platform and also being used to move the assembly platform.

An elevator system of this kind is advantageous in that not only the machine platform but also an assembly platform arranged in the elevator shaft above the machine platform can be adjusted, i.e. can at least be raised, by means of a single lifting device in the elevator shaft. Arranging the relatively heavy drive of the lifting device on the machine platform is also advantageous in that the weight of the drive, as well as the weight of the heavy machine platform, are of little significance during raising, in that the drive can be easily accessed on the machine platform, and in that a power supply, for the elevator drive machine, is already present on the machine platform.

A further solution to the problem consists of a method for erecting an elevator system in an elevator shaft of a building, in which method a usable lifting height of the elevator system is adapted to an increasing height of the building by at least one lifting process being carried out, in which method a machine platform comprising an elevator drive machine, an elevator car suspended on the machine platform by means of at least one bearing means, and a lifting device are arranged in the elevator shaft, the machine platform, together with the elevator car suspended on the machine platform, being raised in the lifting process by means of the lifting device in the elevator shaft, and an assembly platform that can be mechanically moved relative to the machine platform along a portion of the elevator shaft being arranged in the elevator shaft, and a drive of said lifting device being arranged on the machine platform and the lifting device also being used to move the assembly platform.

In one possible embodiment of the method, the machine platform is supported against the building or against the elevator shaft and is not suspended on the lifting device when the lifting device is connected to the assembly platform, and in every operating state the assembly platform is arranged between a protective roof of the machine platform and a protective platform that is designed as a bearing structure for the lifting device, and the assembly platform is supported against the building or against the elevator shaft or on the machine platform when the machine platform is suspended in the elevator shaft by means of the lifting device, and the lifting device is connected, by means of a connecting hook of the lifting device, to the machine platform before the lifting process and to the assembly platform after the lifting process, and the lifting device is designed as a block and tackle, the connecting hook being attached to a free roller block of the block and tackle, the block and tackle being designed such that the reeving is at least 3:1 for lifting the machine platform or at least 2:1 for holding or adjusting the assembly platform, and a cable reservoir for the block and tackle cable is arranged on the machine platform.

A further possible solution to the problem consists of an elevator system which is produced in accordance with the aforementioned method.

In one of the possible embodiments of the subject matter of the invention, the drive of the lifting device is designed as a continuous cable winch.

A continuous cable winch is a cable pull which is driven by means of a motor or by hand and in which the cable, usually a wire cable, is pulled toward the cable pull through drive elements pressed against the cable and is ejected out of said cable pull without the cable being wound in the process. This is advantageous in that the drive requires little installation space, while the cable can be wound at the most suitable place.

In one of the possible embodiments of the subject matter of the invention, the machine platform has adjustable support means by means of which the machine platform can be temporarily immovably supported in the elevator shaft in a suitable manner when said machine platform is not suspended on the lifting device. Support means of this kind allow the machine platform to be stably fixed in the elevator shaft once a lifting process has occurred. The lifting device can subsequently be relieved and be available for raising or lowering the assembly platform until the next lifting process is to be carried out.

In a preferred embodiment of the subject matter of the invention, until the end of its use in the elevator system, the assembly platform is always arranged between the machine platform and a protective platform in the elevator shaft that is designed as a bearing structure, which protective platform is used as a support for raising the machine platform and the assembly platform by means of the lifting device.

The assembly platform also remains in the elevator shaft during a lifting process. For example, during a lifting process the assembly platform can be supported on the machine platform and can then be raised in the elevator shaft together with the machine platform, or, before a lifting process, the assembly platform can, in the vicinity of the protective platform that is designed as a bearing structure, be rigidly coupled to said platform before it is decoupled from the lifting device. The bearing means of the lifting device, usually wire cables, are in this case preferably guided through at least one opening in the base of the assembly platform.

In an alternative embodiment of the subject matter of the invention, the assembly platform is not arranged in the elevator shaft when the lifting device is connected to the machine platform. To this end, the assembly platform is removed from the elevator shaft before a lifting process, for example through one of the shaft wall openings for the shaft doors. The machine platform can therefore be lifted close to the lifting device during a lifting process. Once the lifting device has been positioned higher up in the elevator shaft before a further lifting process, the assembly platform can be reintroduced into the elevator shaft. This then facilitates further assembly works from the assembly platform. Once assembly works of this kind have been carried out, the assembly platform can be removed again from the elevator shaft, and a further lifting process can take place in order to raise the machine platform and the elevator car suspended on the machine platform once the building height has reached the growth required therefor.

In one of the possible embodiments of the subject matter of the invention, the lifting device has at least one connecting hook such that the lifting device can optionally be connected to the machine platform or to the assembly platform via the connecting hook. As a result, assembly staff can simply carry out a conversion in order to ensure that the assembly platform or the machine platform can alternately be adjusted, i.e. raised or lowered, using the same lifting device.

In one of the possible embodiments of the subject matter of the invention, a component of the lifting device is immovably fastened to a protective platform that is temporarily arranged in or over the elevator shaft and is designed as a bearing structure. The component of the lifting device is, for example, the stationary (upper) block of a block and tackle. The protective platform designed as a bearing structure is preferably positioned in or over the temporarily uppermost part of the elevator shaft in the construction. It is used both as a carrier for the lifting device and as a protective platform against weather effects such as rain and snow and against falling materials or objects that come from construction activity on the building.

In one of the possible embodiments of the subject matter of the invention, the lifting device comprises a block and tackle comprising a stationary roller block, a free roller block and a block and tackle cable, the connecting hook being provided on a free roller of the block and tackle and the block and tackle being designed such that the reeving is at least 3:1 for lifting the machine platform or at least 2:1 for holding and/or adjusting the assembly platform. An embodiment of this kind, in which even greater reeving ratios can also be produced, is advantageous in that a relatively large lifting force is available at a relatively low speed in order to raise the heavy machine platform together with the elevator car suspended thereon, whereas a higher speed can be achieved at a lower required lifting force when the substantially lighter assembly platform is being adjusted.

In one of the possible embodiments of the subject matter of the invention, an (upper) stationary roller block of the block and tackle is the component which is fastened on a protective platform that is temporarily arranged in or over the elevator shaft and designed as a bearing structure, a cable line of a block and tackle cable extending from a roller of this roller block to the drive of the lifting device, which is designed as a block and tackle, that is arranged on the machine platform. This allows an advantageous arrangement of the drive of the lifting device.

In one of the possible embodiments of the subject matter of the invention, a cable reservoir for the block and tackle cable of the block and tackle is arranged on the machine platform. In a lifting process, the block and tackle cable is guided from the drive of the lifting device, which drive is designed as a continuous cable winch, to the cable reservoir and wound there. In a lowering process, the continuous cable winch causes the block and tackle cable to be conveyed out of the cable reservoir through the continuous cable winch to the block and tackle. An automatic retracting mechanism is advantageously integrated in the cable reservoir.

In one of the possible embodiments of the subject matter of the invention, at least one of the portions that extend between the upper stationary roller block and the free roller block or the portion of the block and tackle cable that extends between the upper roller block and the drive of the lifting device that is arranged on the machine platform is guided through at least one opening in a base of the assembly platform when the machine platform is suspended on the lifting device that is designed as a block and tackle. This enables a block and tackle to be easily used to raise the machine platform without the assembly platform having to be removed from the elevator shaft in the process.

In one of the possible embodiments of the subject matter of the invention, a ring into which the connecting hook can be hooked is arranged on the machine platform or on a protective roof of the machine platform, and a further ring into which the connecting hook can be hooked is arranged on the assembly platform. In particular, the relevant ring can thus be reached by the assembly staff directly from the machine platform or the assembly platform, and the connecting hook of the lifting device can be unhooked on the assembly platform and hooked in on the machine platform, and vice versa, with little expenditure of time.

In one of the possible embodiments of the subject matter of the invention, a protective roof that covers substantially the entire machine platform and is arranged above the elevator drive machine arranged on the machine platform is provided on the machine platform. The protective roof is intended to protect assembly staff from objects falling in the elevator shaft. It can form an accessible platform over the machine platform. This makes it possible for certain assembly works to be carried out from the machine platform protected by the protective roof, and from a position on the protective roof of the machine platform.

An embodiment of the invention shall be described in greater detail in the following description with reference to the accompanying drawings.

DETAILED DESCRIPTION

Figure 1:
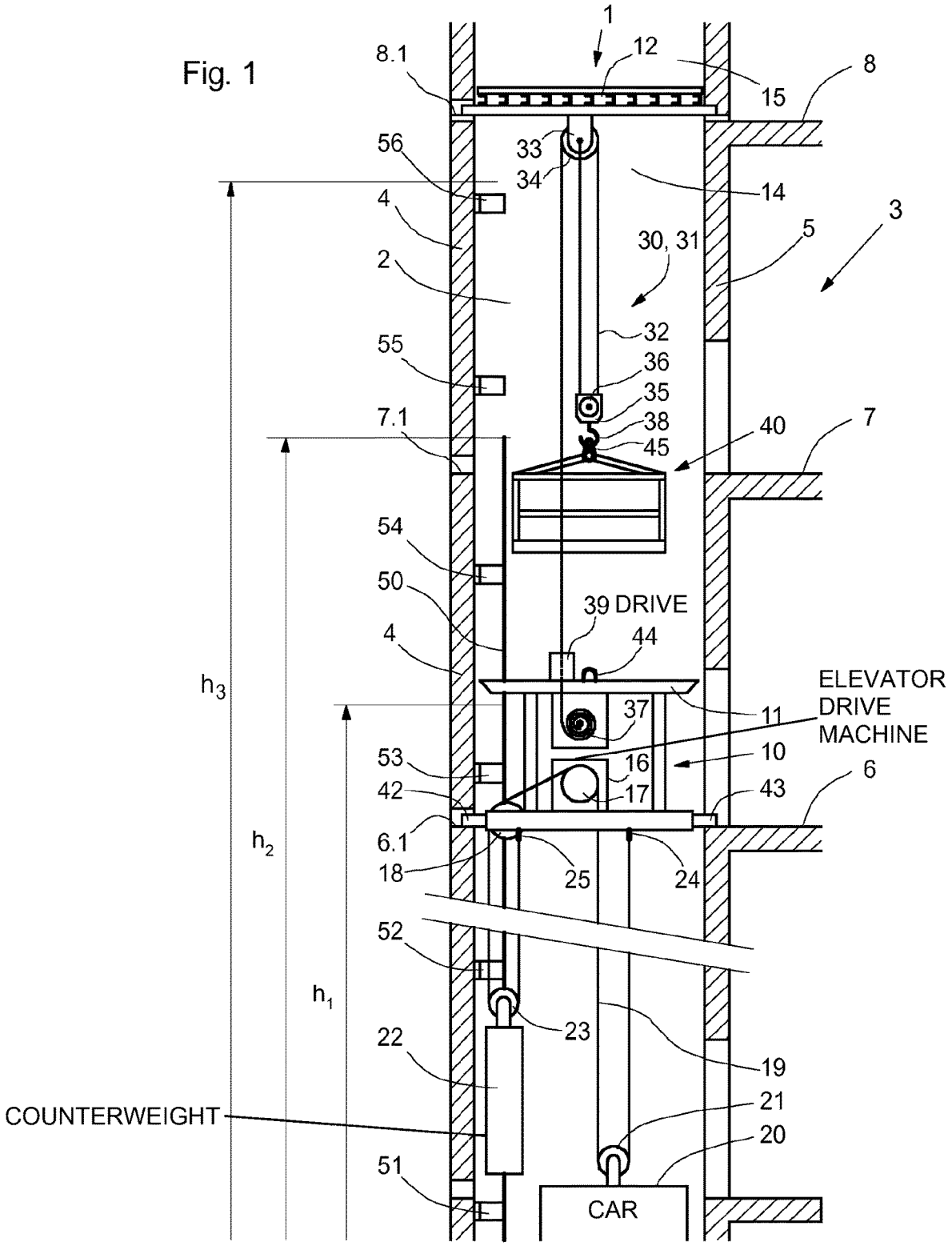
FIG. 1 is a partial schematic view of an elevator system growing with the increasing building height in an elevator shaft of a building, according to a first operating state.

FIG. 1 shows an embodiment of an elevator system 1 growing with the increasing building height in an elevator shaft 2 of a building 3, according to a first operating state. In this case, walls 4, 5 or wall structures 4, 5 of the building 3 are shown, between which the elevator shaft 2 is provided. In this case the walls 4, 5 grow in height in accordance with the vertical growth of the building 3 while the building 3 is being erected. Floors 6, 7, 8 are also shown schematically. In this case, possibilities for supporting elements of the elevator system 1 are created on the floors 6, 7, 8. For example, a recess 6.1 is provided in the wall 4 opposite the floor 6. Correspondingly, recesses 7.1, 8.1 are provided in the wall 4 opposite the floors 7, 8. However, the possibility for supporting elements of the elevator system 1 can also be provided between the floors 6, 7, 8, for example by corresponding recesses in the walls 4, 5. In one modified embodiment, supports can also be produced in other ways. For example, fastenings to the walls 4, 5 are also conceivable, in which fastenings the walls 4, 5 remain closed.

The growing elevator system 1 comprises a machine platform 10 provided with a preferably accessible protective roof 11, on which machine platform an elevator car 20 and a counterweight 22 are suspended by means of bearing means 19. The machine platform 10 is temporarily immovably positioned in the elevator shaft 2 by means of retractable and extendable support means 42, 43 which are parts of the machine platform 10.

An elevator drive machine 16 is arranged on the machine platform 10 and comprises a traction sheave 17. A deflection roller 18 is also arranged on the machine platform 10. Bearing means 19 are guided over the traction sheave 17 and extend out of one side of the traction sheave downwards to a deflection roller 21 arranged on the elevator car 20, loop around this deflection roller and subsequently extend upwards to cable fixing points 24 present on the machine platform 10. The bearing means 19 first run out of the other side of the traction sheave toward a deflection roller 18, extend out of this deflection roller downwards to a deflection roller 23 arranged on the counterweight 22, loop around this deflection roller and subsequently extend upwards to second cable fixing points 25 present on the machine platform 10. In so doing, the elevator car 20 and the counterweight 22 are suspended on the machine platform 10 and thus in the elevator shaft 2, and are driven by the elevator drive machine 16 via the traction sheave 17 and the bearing means 19.

For simplification, a situation is shown in which the ends of the bearing means 19 are rigidly connected to the machine platform 10 at cable fixing points 24, 25. However, a suitable mechanism can be provided for supplying additional bearing means 19 out of a bearing means reservoir at one of these points when a greater usable height of the elevator shaft 2 is available for the elevator car 20 after a lifting process.

The elevator system 1 also comprises an assembly platform 40. This is used as a work platform for assembly staff and as a means for transporting elevator components which are to be mounted. Before each lifting process, i.e. before the machine platform is raised to a higher building level, guide rails 50 for the machine platform 10, for the elevator car 20 and for the counterweight 22 are attached to the walls 4, 5 of the elevator shaft 2 above the machine platform from the assembly platform 40.

The growing elevator system 1 also comprises a protective platform 12 that is designed as a bearing structure and largely covers the elevator shaft 2. The protective platform 12 is temporarily positioned and supported above the machine platform 10 in or over the elevator shaft 2. On account of the protective platform 12 that is designed as a bearing structure, the lower elevator shaft part 14 that is below the protective platform is protected from materials or objects falling onto the region of the elevator shaft, which materials or objects can in particular come from construction activity on the growing building. An upper elevator shaft part 15 of the elevator shaft 2 that is above the protective platform can be open at the top while the building 3 is being erected, and in principle there is therefore a danger of falling objects. In a situation of this kind, the protective platform 12 allows work to be carried out in the lower elevator shaft part 14 of the elevator shaft 2.

In addition to its protective function, the protective platform 12 that is designed as a bearing structure is also used as a bearing element on which a lifting device 30 can be temporarily immovably fastened or suspended in the elevator shaft 2. Since the protective platform 12 is at least temporarily immovably arranged in or over the elevator shaft 2, the stationary parts of the lifting device 30 are therefore also temporarily fixed in the elevator shaft 2.

The lifting device 30 is used both to lift and lower the assembly platform 40 and to carry out a lifting process, i.e. to raise the machine platform 10 together with the elevator car and the counterweight to a higher building level that corresponds to the construction progress. In the operating state shown in FIG. 1, the protective platform 12 designed as a bearing structure is located one floor above the floor 7, i.e. on the floor 8. The relatively light protective platform 12, which is raised to a suitable new height by a construction crane and supported there before the beginning of each lifting process, could also be positioned at a greater vertical distance, optionally limited by the lifting device 30, above the machine platform 10, for example at a distance which corresponds to several distances between floors. The assembly platform 40 is arranged above the machine platform 10, the assembly platform 40 being suspended on a connecting hook 38 of the lifting device 30. After preparatory works have been carried out, in particular after guide rails have been attached to the walls 4, 5 of the elevator shaft above the machine platform as required, and after the connecting hook 38 of the lifting device 30 has been transferred from the assembly platform 40 to the machine platform 10, the lifting process described above can be carried out from the operating state shown in FIG. 1.

In the embodiment shown, the lifting device 30 comprises a block and tackle 31. An upper stationary roller block 33 of the block and tackle is arranged in the lower part 14 of the elevator shaft 2 below the protective platform 12 that is designed as a bearing structure, and is fastened thereto. A lower free roller block 35 is suspended on two strands of the block and tackle cable 32 and carries, on the lower end thereof, the connecting hook 38 by means of which the assembly platform 40 or the machine platform 10 can optionally be coupled to the lifting device 30 and therefore raised or lowered.

In the block and tackle 31, one end of a block and tackle cable 32 is fastened to a fixing point on the upper stationary roller block 33 connected to the protective platform 12. The block and tackle cable 32 extends downwards from this fixing point toward a roller 36 of the free roller block 35, loops around this roller, extends upwards to a roller 34 of the upper stationary roller block 33, loops around this roller and extends downwards to a drive 39 that is arranged on the machine platform 10 and drives the block and tackle cable 32, from which drive the block and tackle cable 32 is guided into a cable reservoir 37.

The drive 39 of the block and tackle 31 of the lifting device 30 is designed as a cable pull mechanism in the form of what is referred to as a continuous cable winch, in which, by means of a motor or by hand, the block and tackle cable 32, usually a wire cable, is pulled toward the continuous cable winch by means of drive elements pressed against the block and tackle cable and is ejected out of said mechanism again without the cable being wound in the continuous cable winch. In a lifting process, the block and tackle cable 32 is guided from the drive 39, which is designed as a continuous cable winch, to the cable reservoir 37 and wound there. In a lowering process, the drive 39 or the continuous cable winch causes the block and tackle cable 32 to be conveyed out of the cable reservoir 37 through the continuous cable winch toward the block and tackle 31. An automatic retracting mechanism is advantageously integrated in the cable reservoir 37. In the present embodiment, the drive 39 is arranged on the protective roof 11 of the machine platform 10, but could also be fastened to other points of the machine platform.

By actuating the drive 39, the distance between the stationary roller block 33 and the free roller block 35 of the block and tackle 31 can be shortened or lengthened, i.e. the free roller block 35 comprising the connecting hook 38 is raised or lowered. The block and tackle 31 is designed such that the reeving is 2:1 when the assembly platform is being raised as shown in FIG. 1, and therefore the tensile force to be exerted on the block and tackle cable 32 by the drive 39 corresponds to approximately half of the lifting force to be applied by the block and tackle. In the operating state that is shown in the following in FIG. 2, the block and tackle 31 has reeving of 3:1 for raising the machine platform 10, i.e. such that the tensile force to be exerted on the block and tackle cable 32 by the drive 39 corresponds to approximately a third of the lifting force to be applied by the block and tackle.

In order to connect the connecting hook 38 of the lifting device 30 to the machine platform 10 or to the assembly platform 40, a ring that is attached to each of the mentioned platforms is used in each case. According to the embodiment, a ring 44 is fastened to the protective roof 11 of the machine platform 10, and a ring 45 is integrated in the bearing construction of the assembly platform 40. In this case, the connecting hook 38 can be hooked into each one of the two rings 44, 45, and this can be carried out by assembly staff from the machine platform 10. The connecting hook 38 can also be correspondingly detached by assembly staff.

In order to prepare a lifting process, the assembly platform 40 is preferably lowered onto the machine platform 10 and supported on said machine platform. However, the assembly platform could also, in the vicinity of the protective platform 12 that is designed as a bearing structure, be fixed to said platform or to the elevator shaft. The connecting hook 38 of the lifting device 30 is then transferred from the assembly platform 40 to the machine platform 10. The counterweight 22 can also be lowered in the elevator shaft 2 until it is supported on the base of the elevator shaft, for example on a suitable buffer. The elevator car 20 that is now in the vicinity of the machine platform 10 can be coupled to the machine platform 10 by means of a suitable additional means, for example a chain, such that the bearing means 19 is relieved. Once the lifting device 30 or the block and tackle 31 has raised the machine platform 10 sufficiently far that the supporting means 42, 43 of the machine platform 10 are relieved, the supporting means can be pulled into the machine platform.

The machine platform 10, together with the elevator car 20 and optionally with the assembly platform 40 supported thereon, is subsequently raised to the intended level by the block and tackle 31 being correspondingly actuated or by the drive 39 of said block and tackle being activated. In this lifting process, the relieved bearing means of the elevator car 20 and of the counterweight 22 are expediently lengthened by the required amount of bearing means being supplied after the corresponding bearing means fixing points have been detached.

For example, as shown in FIG. 1, the protective platform 12 that is designed as a bearing structure can be arranged two floors above the machine platform 10 at the beginning of a lifting process. In the lifting process, the machine platform 10 is raised by one floor. This therefore results in the situation shown in FIG. 2 when the lifting process has finished.

Figure 2:
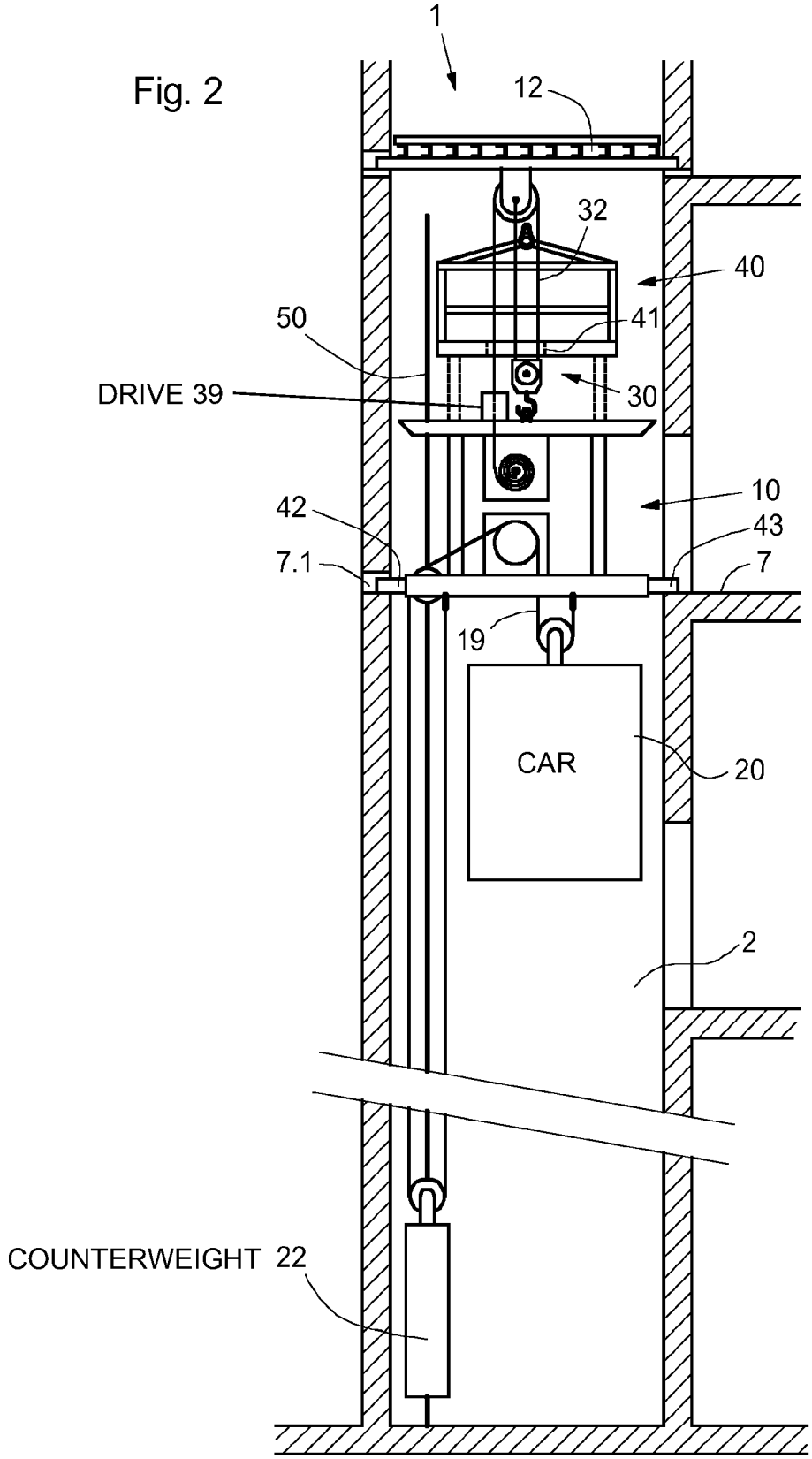
FIG. 2 shows the growing elevator system shown in FIG. 1 in a second operating state in order to explain the invention.

In order to explain the invention, FIG. 2 shows the growing elevator system 1 shown in FIG. 1 in a second operating state. This shows a situation as is usually produced after a lifting process. By means of the lifting device 30 that is now coupled to the machine platform 10, the machine platform 10 can, together with the assembly platform 40 supported thereon and the elevator car 20 coupled to the machine platform, be raised to a higher building level that corresponds to the construction progress, and the extended support means 42, 43 of said machine platform are lowered onto provided support points, on the floor base 7 and the recesses 7.1. Once the bearing means 19 that carry the elevator car 20 and the counterweight 22 have been adapted to the now increased usable lifting height and fixed again, and certain components assigned to the newly accessed floors have been installed, the elevator system can resume normal operation and in the process serve a higher number of floors.

If, as a result of the construction progress, a further lifting process is required, i.e. the machine platform 10 is required to be raised further, a new raising cycle can be started, with the protective platform 12 that is designed as a bearing structure first being raised by means of a construction crane, then the assembly platform 40 being coupled to the lifting device 30 as an additional assembly means, the guide rails 50 and other elevator components subsequently being mounted, from the assembly platform 40, in the gap between the raised protective platform 12 and the machine platform 10, and then the machine platform 10, together with the elevator car 20 suspended thereon and counterweight 22 suspended thereon, and optionally together with the assembly platform 40 supported thereon, being raised to and supported on its new temporary position by means of the same lifting device 30.

FIG. 2 shows that, when the machine platform 10 is being raised, at least one cable of the lifting device 30, for example the strands of the block and tackle cable 32, is or are guided through at least one opening 41 present in the base of the assembly platform 40.

The assembly platform 40 can be used by one or more assembly staff in order to carry out assembly works in the elevator shaft 2. In particular, these can be preparatory assembly works which are required at least in part for the next lifting process. In the following, an example of assembly work of this kind using a guide rail 50 is described by way of example.

Proceeding from a situation as shown in FIG. 1, a guide rail 50 that is used as a counterweight guide rail can first be mounted up to a height $h_1$. Corresponding guide rails can be provided for the machine platform 10 and the elevator car 20. The guide rail 50 is connected to the wall 4 of the building 3 by means of suitable fastening structures 51-53. The guide rails that extend up to the height $h_1$ are in this case sufficient for operating the elevator system 1 in the situation shown.

As can be seen from FIG. 1, further fastening structures 54-56 can be mounted in the elevator shaft 2. In this case, the fastening structure 54 can be fastened to the wall 4 from the protective roof 11 of the machine platform 10, for example. The adjustable assembly platform 40 also allows the fastening structure 54, as well as all fastening structures 55, 56 that are located higher up, to be fastened to the wall 4. The guide rail 50 can in this case be lengthened upwards in a stepwise manner. In this case FIG. 1 shows a situation in which the guide rail 50 is lengthened up to a height $h_2$. This height $h_2$ is in this case greater than the height $h_1$ that had been present directly after the lifting process. The guide rail 50 can then be lengthened further at least to the height $h_3$.

It is obviously also possible to implement suitable modifications to the described assembly process. The assembly platform 40 can also be used to attach a plurality of fastening structures 55 to the wall 4, for example. Moreover, not only fastening structures 53 to 55 but also other elevator components such as safety devices, switching apparatuses, lights, electrical leads and in particular elevator doors to the floors can be mounted or installed at least in part from the assembly platform 40.

The invention relates to a growing elevator system 1 which is erected in an elevator shaft 2 of a building 3 and grows by using at least one lifting process. It is possible to implement suitable modifications to the described embodiment in this case. In particular, the invention is not limited to the described embodiment and the described modifications.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system arranged in an elevator shaft of a building in a construction phase, the elevator system growing with an increasing height of the building by using at least one lifting process, comprising:

a machine platform including an elevator drive machine;

an elevator car suspended on the machine platform by a bearing means, wherein the machine platform and elevator car can be raised in the elevator shaft during the at least one lifting process;

a lifting device for raising the machine platform and the elevator car suspended on the machine platform;

an assembly platform that can be mechanically moved relative to the machine platform along a portion of the elevator shaft; and wherein the lifting device includes a drive arranged on the machine platform and connected to the assembly platform for moving the assembly platform in the elevator shaft.

2. The elevator system according to claim 1 where in the drive of the lifting device is a continuous cable winch.

3. The elevator system according to claim 1 wherein the machine platform has adjustable support means for temporarily immovably supporting the machine platform in the elevator shaft.

4. The elevator system according to claim 1 wherein the assembly platform is arranged, until an end of its use in the elevator system, between the machine platform and a protective platform in the elevator shaft, the protective platform being a bearing structure supporting the raising of the machine platform and the assembly platform by the lifting device.

5. The elevator system according to claim 1 wherein the lifting device has a connecting hook for releasably connecting the lifting device to the machine platform or to the assembly platform.

6. The elevator system according to claim 5 wherein the lifting device includes a block and tackle having a reeving greater when the machine platform is being raised than when the assembly platform is being held and adjusted.

7. The elevator system according to claim 5 wherein the lifting device includes a block and tackle having a stationary roller block, a free roller block and a block and tackle cable, the connecting hook being on the free roller block.

8. The elevator system according to claim 7 wherein the stationary roller block is immovably fastened to a protective platform arranged in or above the elevator shaft, the protective platform being a bearing structure.

9. The elevator system according to claim 7 wherein the stationary roller block includes a roller, a cable line of the block and tackle cable extending from the roller to the drive of the lifting device that is arranged on the machine platform.

10. The elevator system according to claim 7 including a cable reservoir for the block and tackle cable arranged on the machine platform.

11. The elevator system according to claim 7 wherein at least one portion of the block and tackle cable that extends between the stationary roller block and the free roller block and/or a portion of the block and tackle cable that extends between the stationary roller block and the drive of the lifting device is guided through an opening in a base of the assembly platform when the machine platform is suspended on the lifting device.

12. The elevator system according to claim 5 including a ring into which the connecting hook can be hooked is arranged on the machine platform, and/or a ring into which the connecting hook can be hooked is arranged on the assembly platform.

13. The elevator system according to claim 1 including a protective roof arranged on and covering the machine platform above the elevator drive machine.

* * * * *